US007381248B2

(12) United States Patent
Kim et al.

(10) Patent No.: US 7,381,248 B2
(45) Date of Patent: Jun. 3, 2008

(54) CYCLONE DUST-SEPARATING APPARATUS WITH DISCHARGE ELECTRODES

(75) Inventors: Min-ha Kim, Gwangju (KR); Jung-gyun Han, Gwangju (KR); Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 4 days.

(21) Appl. No.: 11/515,261

(22) Filed: Sep. 1, 2006

(65) Prior Publication Data

US 2007/0157814 A1 Jul. 12, 2007

(30) Foreign Application Priority Data

Jan. 11, 2006 (KR) ..... 10-2006-0003080

(51) Int. Cl.
*B03C 3/15* (2006.01)

(52) U.S. Cl. ..... 96/61; 55/360; 96/97; 96/98

(58) Field of Classification Search ..... 96/60–62, 96/95–100; 95/78; 55/360, DIG. 38
See application file for complete search history.

(56) References Cited

U.S. PATENT DOCUMENTS 888,638 A * 5/1908 Morscher ..... 96/61
2,081,772 A * 5/1937 Saint-Jacques ..... 95/63
4,010,011 A * 3/1977 Reif ..... 96/61
4,066,526 A * 1/1978 Yeh ..... 204/554
4,309,199 A * 1/1982 Suzuki ..... 96/18
4,352,681 A * 10/1982 Dietz ..... 96/61
4,390,426 A * 6/1983 Vicard ..... 210/243
4,649,703 A * 3/1987 Dettling et al. ..... 60/275
4,689,951 A * 9/1987 Polach ..... 60/275
5,683,494 A * 11/1997 Altman et al. ..... 96/55
5,888,276 A * 3/1999 Price et al. ..... 96/17

(Continued)

FOREIGN PATENT DOCUMENTS

GB 2084904 4/1982

(Continued)

OTHER PUBLICATIONS

Office Action dated Oct. 16, 2007 corresponding to Russian Patent Application No. 2006134484.

(Continued)

*Primary Examiner*—Richard L Chiesa
(74) *Attorney, Agent, or Firm*—Ohlandt, Greeley, Ruggiero & Perle, LLP.

(57) ABSTRACT

A cyclone dust-separating apparatus in which the electrical field and particle charge can be uniform and stable. The cyclone dust-separating apparatus comprises: a cyclone body; an air intake pipe, through which air flows from outside into the cyclone body; an air exhaust pipe, through which air flows out of the cyclone body; a grounding member installed on the inside surface of the cyclone body; a plurality of discharge electrode members installed on the air exhaust pipe; and a high voltage power source connected to the air exhaust pipe. The air exhaust pipe conducts electricity, and the discharge electrode members are installed on one or more sides of the air exhaust pipe, are needle-shaped, and protrude from the outer surface of the air exhaust pipe so as to form a uniform and stable electrical field.

5 Claims, 3 Drawing Sheets

U.S. PATENT DOCUMENTS

| | | | | |
|---|---|---|---|---|
| 5,968,231 | A * | 10/1999 | Parmentier et al. | 95/28 |
| 6,228,148 | B1 * | 5/2001 | Aaltonen et al. | 95/74 |

FOREIGN PATENT DOCUMENTS

| | | | | |
|---|---|---|---|---|
| JP | 55-78159 | A * | 6/1980 | 96/61 |
| KR | 1020000067038 | | 11/2000 | |
| KR | 1020020079159 | | 10/2002 | |
| RU | 184603 | | 7/1966 | |
| RU | 971475 | | 11/1982 | |
| RU | 2236909 | | 9/2004 | |
| RU | 2005-028243 | | 2/2005 | |

OTHER PUBLICATIONS

Office Action dated Nov. 20, 2007 corresponding to Australian Patent Application No. 2006213967.

* cited by examiner

CYCLONE DUST-SEPARATING APPARATUS WITH DISCHARGE ELECTRODES

CROSS REFERENCE TO RELATED APPLICATIONS

This application claims benefit under 35 U.S.C. § 119(a) of Korean Patent Application No. 2006-03080, filed Jan. 11, 2006, the entire contents of which are incorporated herein by reference.

BACKGROUND OF THE INVENTION

1. Field of the Invention

This disclosure relates to a cyclone dust-separating apparatus, and more specifically to a cyclone dust-separating apparatus comprising a plurality of discharge electrodes to raise dust-separating efficiency by improving the form of the electrode that transmits a high voltage.

2. Description of the Prior Art

Cyclone dust-separating apparatus with discharge electrodes are widely used in vacuum cleaners in order to remove dust from the floor of homes and offices, and remove contaminants from gas released from boilers or incinerators.

A conventional cyclone dust-separating apparatus comprises an air intake pipe, which draws air or gas from outside the vacuum cleaner; discharge electrodes, which electrically charge the drawn-in fluid; and an air exhaust pipe, through which drawn-in fluid flows out of the vacuum cleaner. The flat bar or support rods of the discharge electrodes are generally installed extending downward from the center of the exhaust pipe.

However, although the electric field of conventional cyclone dust-separating apparatus with this kind of discharge electrode is axially symmetrical, because the strength of the electric field decreases nearer to the radial direction of the discharge electrodes formed as flat bars or support rods, or to the wall, the average electrical charge of particles varies depending on the radial direction and the axial direction. Moreover, the electrical charge is unstable at a high flow rate, so a spark can occur or dust can build up on the support rods.

SUMMARY OF THE INVENTION

An aim of the present disclosure is to provide a cyclone dust-separating apparatus able to distribute the average electric charge uniformly inside the cyclone body and thereby increase dust-separating efficiency.

Another aim of the present disclosure is to provide a cyclone dust-separating apparatus in which the electrical charge of particles is stable even at a high flow rate.

The dust-separating apparatus designed in order to achieve the above aims comprises a cyclone body; an air intake pipe, through which air flows from outside into the cyclone body; an air exhaust pipe through which air flows out of the cyclone body; a grounding member installed on an entire inside surface of the cyclone body; a plurality of discharge electrode members installed on the air exhaust pipe; and a high voltage power source connected to the air exhaust pipe. The air exhaust pipe conducts electricity, and the plurality of discharge electrode members are needle-shaped, protruding from at least a part of the outer surface of the air exhaust pipe.

A plurality of discharge electrode members can be installed in the area where the air exhaust pipe comes into contact with the uppermost surface of the cyclone body, and the air exhaust pipe may further comprise a mesh section, which charges and filters dust particles.

Moreover, the air exhaust pipe may comprise a cylindrical section and a tapering section, the mesh section may be formed on at least a part of the tapering section, and the space between the cyclone body and the air exhaust pipe may be uniform throughout the cyclone body.

The cyclone dust-separating apparatus, designed in order to achieve the aforementioned aims, may alternatively comprise: a cyclone body; an air intake pipe, through which air flows into the cyclone body from the outside; an air exhaust pipe, through which air flows out of the cyclone body; a grounding member installed on an entire inside surface of the cyclone body; and a high voltage power source connected to the air exhaust pipe. The exhaust pipe can conduct electricity, and at least a part of the air exhaust pipe is composed of mesh, which is able to charge and filter dust particles.

In the embodiment described here, the entire surface of the air exhaust pipe is composed of mesh, and the air exhaust pipe comprises a cylindrical section and a tapering section.

Cyclone dust-separating apparatus in the embodiments of the present disclosure described above can charge the dust particles evenly, and thereby distribute the average charge of dust particles evenly, by forming a stable and uniform electrical field throughout the interior of the cyclone body using the cylindrical air exhaust pipe traversing the cyclone.

Additionally, the needle-shaped discharge electrode members are installed at the top of the air exhaust pipe, and drawn-in dust is charged in advance and continually charged by the electrically conductive air exhaust pipe, so even if the flow rate is high or the volume of dust is large the electrical charge is uniform and stable.

Moreover, the cyclone body and the air exhaust pipe may be integrally formed, and by preserving a consistent space between the air exhaust pipe, which functions as a discharge electrode, and the grounding member, a more uniform electrical field can be formed.

DESCRIPTION OF THE PREFERRED EMBODIMENTS

Figure 1:
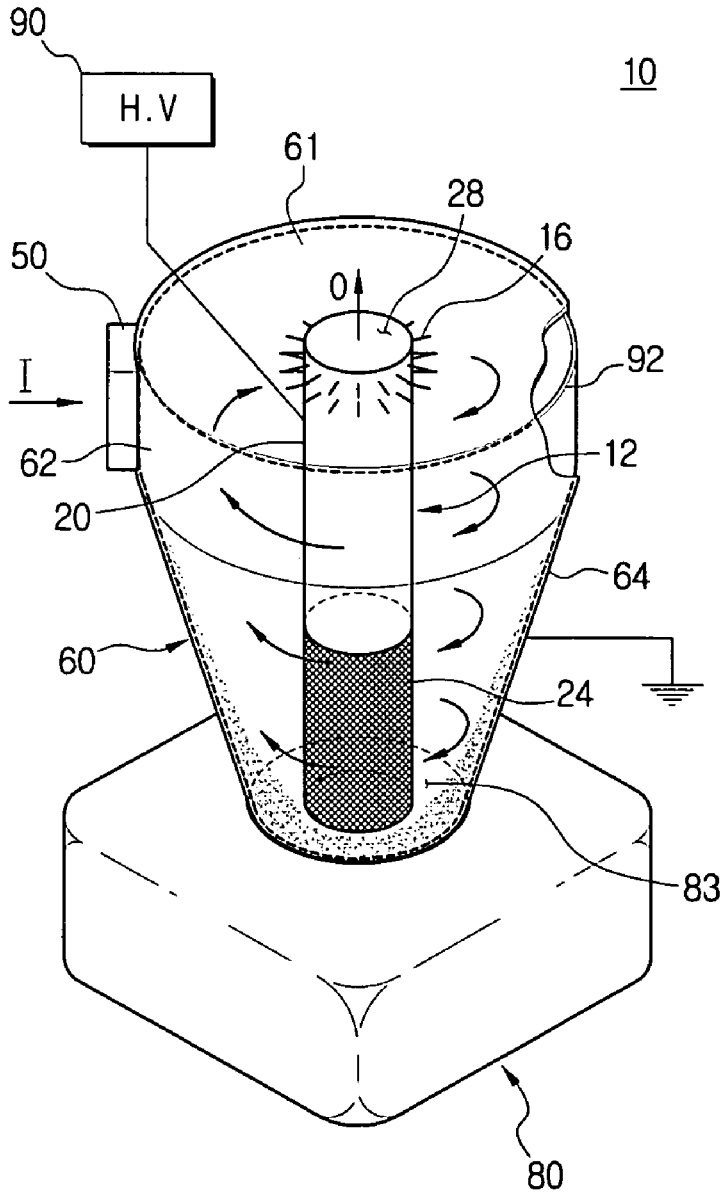
FIG. 1 is a partially incised perspective view schematically showing a first embodiment of the cyclone dust-separating apparatus of the present disclosure.

The preferred embodiments of the present disclosure are explained in greater detail below with reference to the attached drawings. FIG. 1 is a partially incised perspective view schematically showing the first embodiment of the cyclone dust-separating apparatus of the present disclosure.

Referring to FIG. 1, the cyclone dust-separating apparatus 10 comprises an air intake pipe 50, a cyclone body 60, a dust container 80, an air exhaust pipe 12, a plurality of discharge electrode members 16, a grounding member 92, and a high voltage power source 90.

The air intake pipe 50 is installed on one side of the cyclone body 60, and functions as a passage through which fluid flows into the cyclone body 60 from outside. The air intake pipe 50 may be round, quadrangular, or other shapes, but the embodiments described here have a quadrangular pipe.

The cyclone body 60 comprises a cylindrical section 62 and a tapering section 64, which tapers downwards in an inverted cone shape, and is an area into which polluted fluid from outside flows in and made to revolve.

The dust container 80 is connected to the bottom of the cyclone body, and the place where the cyclone body 60 and the dust container 80 meet is open and forms a dust container entrance 83. In this embodiment, the dust container 80 is four-sided and shaped like a box, but there are no restrictions on the shape of the dust container 80. In the cyclone body 60, dust or impurities separated by the centrifugal force and electrical force pass through the dust container entrance 83 and accumulate inside the dust container 80.

The air exhaust pipe 12 is installed so as to traverse the cyclone body 60 from top to bottom, and is connected to the high voltage power source 90, forming a conductor through which electricity can flow. The air exhaust pipe 12 comprises a cylindrical section 20, a mesh section 24, and a plurality of discharge electrode members 16 are installed around the top of the cylindrical section 20, which is connected to the upper surface 61 of the cyclone body 60, protruding from the outer surface of the air exhaust pipe 12. The cylindrical section 20 is an electrically conductive section through which air cannot pass, and the mesh section 24 connected to the bottom of the cylinder 20 conducts electricity and, as a net through which air can pass, filters the dust. In this manner, a high voltage is transmitted throughout the air exhaust pipe 12 and to the discharge electrode members 16, and a corona discharge and electrical field are formed inside the cyclone body 60, so dust can be charged uniformly.

The discharge electrode members 16 are needle-shaped and of a fixed length, and protrude from around the circumferential surface of the exhaust pipe 12. The discharge electrode members 16 can only be installed on certain parts of the air exhaust pipe 12 in order to generate a corona discharge, but in the preferred embodiment described here, the plurality of discharge electrode members are formed around the top of the air exhaust pipe 12.

The grounding member 92 is installed on the entire inside surface of the cyclone body as a conductor. In FIG. 1, the grounding member 92 is installed on the inside surface of the cyclone body 60 except for the upper surface, as shown by the section appearing as a dotted line and the section appearing with one part incised. The grounding member 92, as shown in FIG. 1, is connected to the ground and earthed. In FIG. 1, arrow I indicates the direction in which fluid is drawn into the cyclone body 60, and arrow O indicates the direction in which fluid flows out through the air exhaust vent 28.

FIG. 1 explains in detail the action of the first embodiment of the present disclosure.

If fluid such as polluted air or exhaust gas is drawn into the cyclone body 60 through the air intake pipe 50, the drawn-in fluid is caused to rotate by the high velocity at which it enters the cyclone body 60. The high voltage power source 90 transmits a high negative voltage to the air exhaust pipe 12, so the whole of the air exhaust pipe 12 and the needle-shaped electrode discharge members 16 have a high negative voltage, so the corona discharge starts and an electrical field forms inside the cyclone body 60. Dust in the drawn-in fluid is negatively charged by the discharge electrode members 16 in advance, and is uniformly charged by the air exhaust pipe while it continues to rotate, and while it descends into the cyclone body 60. In particular, even if the flow rate is high and a large quantity of dust is comprised in the drawn-in fluid, it is possible to charge the dust particles sufficiently by charging the dust covering the entire surface of the cyclone body 60 with the charge of the cylindrical exhaust pipe 12, and a stable and uniform electrical field is formed over the entire inside surface of the cyclone body 60.

Because the negatively-charged dust has the same polarity as the air exhaust pipe 12, in which negative electrodes float, it is driven in the direction of the grounding member 92 disposed on the inside surface of the cyclone body 60, and as shown in FIG. 1, dust and other impurities descend into the dust container through the dust container entrance 83. In this manner dust-separation efficiency is increased by separating dust using the centrifugal force and uniform electrical forces.

Figure 2:
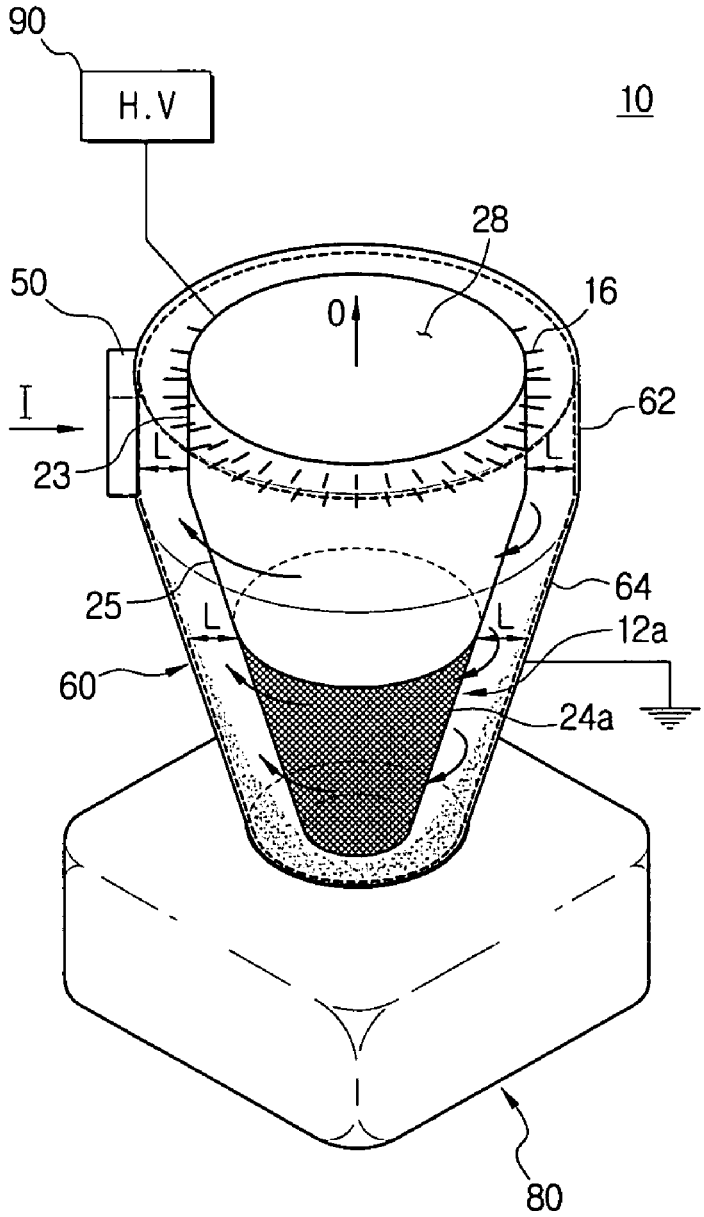
FIG. 2 is a perspective view schematically showing a second embodiment of the cyclone dust-separating apparatus of the present disclosure.

FIG. 2 is a drawing showing the second embodiment of the cyclone dust-separating apparatus of the present disclosure, and differs from FIG. 1 only in the form of the exhaust pipe.

Referring to FIGS. 1 and 2, the air exhaust pipe 12*a* has a cylindrical section 23, and a tapering section 25 which decreases in diameter towards the bottom, so the form is consistent with the cyclone body 60. The air exhaust pipe 12*a* conducts electricity and is connected to the high voltage power source 90, so it functions as a discharge electrode, and the distance L between the outer surface of the air exhaust pipe 12*a* and the grounding member 92 installed on the inner surface of the cyclone body 60 is uniform, regardless of the position in the cyclone body. In other words, referring to FIG. 2, the distance L between the cylindrical section 23 of the air exhaust pipe 12*a*, performing the role of a discharging electrode, and the cylindrical section 62 of the cyclone body 60 is equal to the distance L between the sloped section 25 of the air exhaust pipe 12*a* and the sloped section 64 of the cyclone body 60, so the electric field on the inside of the cyclone body 60 is more uniform and stable.

Figure 3:
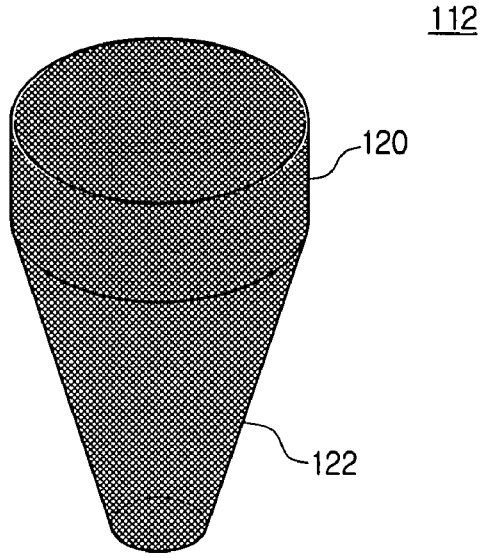
FIG. 3 is a drawing showing only the exhaust pipe of a third embodiment of the cyclone dust-separating apparatus of the present disclosure.

FIG. 3 is a drawing of only the air exhaust pipe 112 of the third embodiment. The remainder of the dust-separating apparatus is identical in form with the embodiment of FIG. 2 described above.

Referring to FIGS. 2 and 3, the air exhaust pipe 112 in the third embodiment functions as a conductor, and the entire air exhaust pipe 112 is formed of mesh. The high voltage power source 90, referring to FIG. 2, and other components in the dust-separating apparatus are identical to those described for the other embodiments. As a result, air can pass through all parts of the air exhaust pipe 112, but the air exhaust pipe 112 is negatively charged, so dust is driven towards the grounding member 92. The cyclone body 60 comprises a cylindrical section 120 and a tapering section 122, as in the preceding embodiments, and the distance L, in FIG. 2, between the mesh air exhaust pipe 112 functioning as a discharge electrode and the grounding member 92 installed on the inside of the cyclone body 60 is consistent irrespective of the position in the cyclone body 60, so a uniform electric field can form on the inside of the cyclone body 60 as in the second embodiment.

Figure 4:
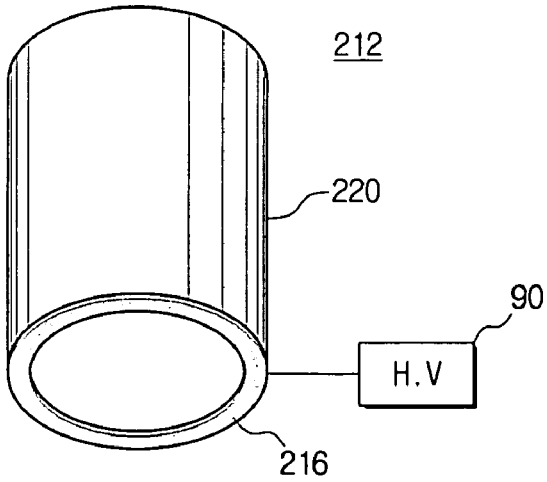
FIG. 4 is a perspective drawing showing only the exhaust pipe of a fourth embodiment of the cyclone dust-separating apparatus of the present disclosure.

FIG. 4, is a drawing showing the fourth embodiment of the present disclosure, and illustrates a different form of the air exhaust pipe 212. The exhaust pipe 212 in this disclosure has only a cylindrical section, and does not conduct electricity. The discharge electrode members 216 connected to the high voltage power source 90 form a ring around the base of the air exhaust pipe 212. As there is no mesh, the air exhaust pipe 212 can be shorter than in the other embodiments, so the discharge electrode members 216 are located approximately midway up the cyclone body 60, referring to FIG. 1.

The present disclosure has been explained and illustrated above referring to a preferred embodiment in order to show the principles of the disclosure, but this disclosure is not restricted to the composition and application of the embodiment explained and illustrated above. Rather it will be readily understood by those skilled in the art of the technical field to which this disclosure belongs that diverse changes and amendments can be made without deviating from the concept and scope of the attached claims. Therefore, all such appropriate changes and amendments must be considered to be within the scope of the present disclosure.

What is claimed is:

1. A cyclone dust-separating apparatus, comprising:

a cyclone body;

an air intake pipe, through which air flows into the cyclone body;

an air exhaust pipe through which air flows out of the cyclone body;

a grounding member installed on an entire inside surface of the cyclone body except for a top inside surface;

a plurality of discharge electrode members installed on the air exhaust pipe; and a high voltage power source connected to the air exhaust pipe; and wherein the air exhaust pipe conducts electricity, and the plurality of discharge electrode members are needle-shaped, protruding from at least a part of an outer surface of the air exhaust pipe, wherein the air exhaust pipe comprises a cylindrical section and a tapering section. and at least a part of the tapering section is formed of mesh.

2. The cyclone dust-separating apparatus according to 1, wherein the plurality of discharge electrode members are installed around an area where the air exhaust pipe connects to a top of the cyclone body.

3. The cyclone dust-separating apparatus according to 1, wherein the air exhaust pipe further comprises a mesh section, which charges and filters dust particles.

4. The cyclone dust-separating apparatus according to 1, wherein the space between the cyclone body and the air exhaust pipe is uniform throughout the cyclone body.

5. A cyclone dust-separating apparatus, comprising:

a cyclone body;

an air intake pipe, through which air flows into the cyclone body from outside the cyclone body;

an air exhaust pipe, through which air flows out of the cyclone body;

a grounding member installed on an entire inside surface of the cyclone body except for a top inside surface; and a high voltage power source connected to the exhaust pipe; and wherein the air exhaust pipe conducts electricity, the entire air exhaust pipe comprises mesh that simultaneously charges and filters dust particles, and the air exhaust pipe comprises a cylindrical section and a tapering section.

* * * * *